United States Patent [19]

Holt et al.

[11] Patent Number: 5,025,509

[45] Date of Patent: Jun. 25, 1991

[54] OVERFLOW LEVEL CONTROLLER FOR A BATHTUB

[76] Inventors: Peter K. Holt, 9682 129th Street, Surrey, British Columbia, Canada, V3T 3G4; George M. Olorenshaw, 11810 Stephens Street, Maple Ridge, British Columbia, Canada, V2X 6S3

[21] Appl. No.: 513,264

[22] Filed: Apr. 25, 1990

[30] Foreign Application Priority Data

Apr. 25, 1989 [CA] Canada ..... 596757

[51] Int. Cl.[5] ..... E03C 1/24

[52] U.S. Cl. ..... 4/206

[58] Field of Search ..... 4/206, 651

[56] References Cited

U.S. PATENT DOCUMENTS

| | | | |
|---|---|---|---|
| 1,262,545 | 4/1918 | Mueller | 4/206 |
| 2,398,921 | 4/1946 | Cook | 4/206 |
| 3,497,878 | 3/1970 | Emery | 4/206 |
| 3,570,020 | 3/1971 | Kato | 4/206 |
| 3,927,428 | 12/1975 | Jette et al. | 4/206 |
| 4,446,583 | 5/1984 | Dean | 4/206 |

*Primary Examiner*—Charles E. Phillips

*Attorney, Agent, or Firm*—Shlesinger Arkwright Garvey

[57] ABSTRACT

An overflow level controller for a bathtub is provided with an adapter ring to facilitate connection with a conventional bathtub fixture base, and includes a housing with a removable covering. Rotation of the housing adjusts the overflow level of the bathtub.

7 Claims, 2 Drawing Sheets

OVERFLOW LEVEL CONTROLLER FOR A BATHTUB

FIELD OF THE INVENTION

This invention relates to bathtub overflow level control devices.

DESCRIPTION OF THE PRIOR ART

A variety of devices have been designed for the purpose of varying or controlling the overflow level of a bathtub. In the absence of such a device, the overflow level is typically dictated by the fixed position of an overflow drain in the side wall of the tub-very often directly below a tap water inlet for the tub.

Early examples of such devices include those disclosed in U.S. Pat. No. 1,235,387 granted to Serper on July 13, 1917, and in U.S. Pat. No. 1,598,162 granted to Solomon on Aug. 31, 1926. In these cases, the devices disclosed simply raise the overflow level by a fixed predetermined distance. Once installed, there is no provision for then adjusting the overflow level, and it appears that they can be installed in only position relative to the overflow drain.

Another early example is disclosed in U.S. Pat. No. 1,531,322 granted to Waechter on Mar. 31, 1925. In this case, although the overflow level is essentially fixed once the device is installed, the position of installation is variable. A suction mechanism is utilized to couple the device with a bathtub wall and, if one wishes to vary the overflow level with this device, he detaches or releases the device and repositions it at a different level. Thus, although the procedure is manipulatively awkward, adjustment of the overflow level provided by the device is possible.

A more sophisticated manner of control is disclosed in U.S. Pat. No. 3,497,878 granted to Emery on Mar. 3, 1970. Emery discloses the use of a rotatable cylindrical covering which is axially aligned with the positioned over the overflow drain of a bathtub. Apart from a hole or port in the circumferential wall of the covering, the covering effectively seals a region around the overflow drain and an overflow drain fixture. The hole or port serves as an overflow port, and adjustment of overflow level is achieved by rotating the cylindrical covering.

Parenthetically, it will be noted that conventional bathtub overflow drains will almost invariably have an "overflow drain fixture" which does not seal the drain but which hides what would otherwise be an ugly opening into the overflow drain pipe and, as well, guards against the entry of large foreign objects that would block the pipe. Further, when attached, the fixture frequently serves to hold the drain pipe securely against the outside wall of the bathtub, a sealing gasket being positioned between the pipe and the wall to prevent leakage outside of the bathtub.

The design of Emery is relatively bulky. One of the problems that he addresses appears to be that of achieving an effective seal between the perimeter of his control device and the bathtub wall. This problem is aggravated by reason of size and because the sealing perimeter in his design is relatively distant from the perimeter of the drain pipe. Suction means are utilized to couple the covering with the bathtub wall. An interesting variation on the rotatable covering type of design is that disclosed in U.S. Pat. No. 3,927,428 granted to Jette et al. on Dec. 23, 1975. In this case, a telescoping tube is provided in the overflow port of a rotatable circumferential wall. The actual overflow level can be varied by rotating the covering and/or by extending the tube. Instead of using suction means or spring pressure means (as in the case of Solomon and Serper) to couple their covering with the bathtub wall, Jette et al. contemplate the use of magnetic or adhesive means to couple their covering to a bathtub wall. It is characteristic of such prior art that the seal or coupling between the overflow level control device and the bathtub is relatively weak and most tend to be relatively bulky in design. Further, no sufficient regard has been paid either to the question of hygenics or to the question of overall aesthetics.

The present invention is designed for use with conventional bathtubs having an overflow drain pipe which provides a drain outlet from the side wall of the bathtub, and a fixture base at the outlet for attaching a bathtub fixture. It is designed not merely to cover a conventional fixture, but to replace such a fixture, and to do so without sacrificing the functions of the conventional fixture. The overflow level control device of the present invention comprises an adapter ring which is sized to fit around the outlet, connecting means for tightly connecting the adapter ring to the base, a cylindrical housing and means for rotatably engaging the housing at one end with an outer perimeter of the adapter ring. A removable covering is provided to sealingly cover the opposite end of the housing. The perimeter of the housing has one or more openings which form or forms (as the case may be) an overflow port which permits the flow of water from the bathtub, through the housing, and into the drain outlet. A sealing means such as a sealing gasket positioned between the bathtub wall and housing prevents the flow of water from the bathtub into the pipe except through the overflow port.

In a preferred embodiment of the present invention, the connecting means comprises a bar extending diametrically across the adapter ring from one side to the other. In this regard, it may be noted that the fixture base which accompanies a great many conventional bathtubs will itself comprise a crossbar or a stud to which a conventional bathtub fixture may be screwed. The crossbar of the present invention, when provided with a screwing hole that aligns with the stud or crossbar normally associated with the conventional fixture can thus be attached itself with relative ease. It is only necessary to remove the conventional fixture and replace it with the overflow level control device of the present invention. The crossbar may be provided with a plurality of screw holes located in positions selected to permit a screwed connection to alternate fixture bases, each of such bases having threaded screw engaging holes in one or more corresponding locations. Thus, it will be apparent that the present invention may be connected to a variety of bathtubs.

The removable covering associated with the present invention achieves at least three purposes. Firstly, it allows easy installation. Secondly, it enables the interior of the cylindrical housing to be cleaned without completely disconnecting the device. Thirdly, it serves an aesthetic purpose in that it enables the user to select a cover design of his choice without necessarily having to replace the entire device or housing. Thus, for example, covers may be provided in differing colours to match differing colours of bathtubs. An individual who moves the device from one bathtub to the next, each bathtub being a different colour, is not confronted with the prospect of replacing the entire device or recolouring the device merely to achieve a colour match. It is only necessary to replace the cover.

The foregoing and other features of the invention will now be described with reference to drawings.

DETAILED DESCRIPTION

Figure 1:
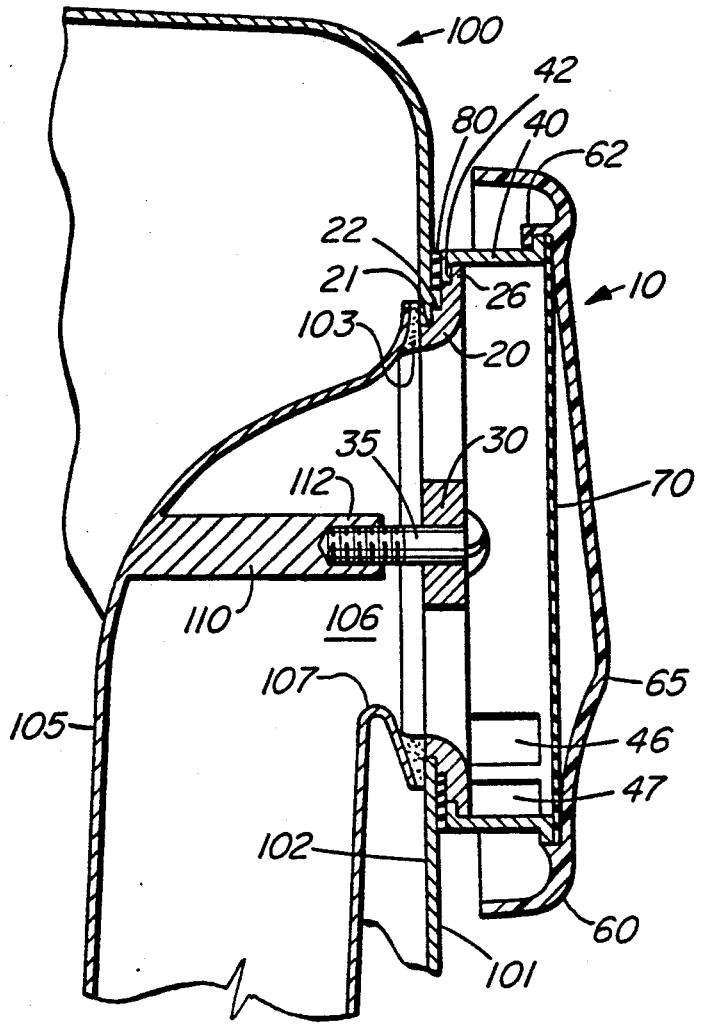
FIG. 1 is a side elevation view, partially cut away, showing an overflow level control device in accordance with the present invention when connected to a bathtub.
Figure 2:
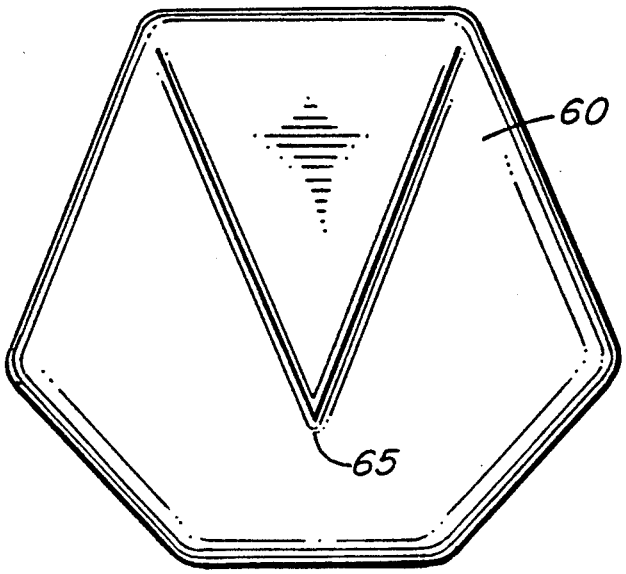
FIG. 2 is a front elevation view of the removable covering shown in FIG. 1.

In FIG. 1, there is shown a bathtub overflow level control device generally designated 10 for a conventional bathtub generally designated 100. Bathtub 100 and parts associated with the bathtub including drain pipe 105 and fixture base or stud 110 are not considered to be part of the invention.

As can be seen, drain pipe 105 provides a drain outlet 106 from side wall 101 of the bathtub. Ordinarily, the overflow level would be at bend 107 of pipe 105. However, as is described below, device 10 permits this level to be adjustably raised.

Fixture base or stud 110 is a conventional means found in many bathtubs for attaching a conventional bathtub fixture (not shown) which serves to cover but not block outlet 106, and to hold pipe 105 securely against outer surface 102 of wall 101. A conventional pliant sealing gasket 103 is positioned between pipe 105 and outer surface 102 to prevent leakage outside the tub.

Overflow level control device 10 comprises an adapter ring 20, a cylindrical housing 40, a removable covering 60, a sealing gasket 70, and a sealing gasket 80. A crossbar 30 forming part of adapter ring 20 provides a connecting means for tightly connecting the ring to stud 110 with a screw 35. As can be seen in FIG. 1, stud 110 includes a hole at end 112 for threadingly receiving the screw. Although not apparent from FIG. 1, stud 110 is aligned with the central axis of opening 106. Screw 35 passes through screw hole 32 best shown in FIG. 4.

Adapter ring 20 is sized to fit around outlet 106. In this regard, it may be noted that outer perimeter 21 of the ring 20 has diameter which just sits within the diameter of the opening through wall 101 to outlet 106.

Housing 40 is rotatably engaged with ring 20 by means of co-operating flanges 26 on ring 20 and 42 on housing 40. The inner diameter of housing 40 is just sufficient to accommodate outer perimeter 24 of ring 20. Although there will be sliding friction between the flange surfaces and edges, it need only be nominal thus permitting smooth easy rotation of the housing relative to the ring.

Figure 3:
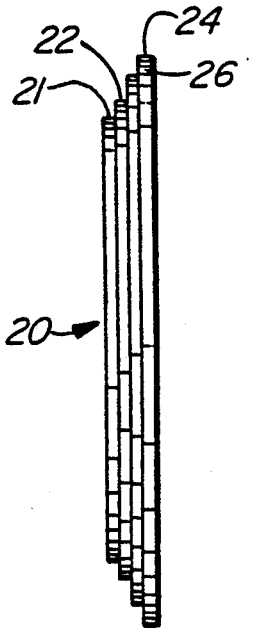
FIG. 3 is a side elevation view of the adapter ring in FIG. 1.

As can be seen in FIG. 1, a sealing gasket 80 is positioned between bathtub wall 101 and housing 40. More particularly, it encircles an outer perimeter 22 of ring 20 and underlies flange 42 of housing 40. This arrangement, and the stepped configuration of adapter ring 20 as best seen in FIG. 3 provides an effective seal against the entry of water from around the adapter ring.

Removable covering 60 is made from a flexible plastic and includes three inwardly extending flanges 62 (only one of which is shown) positioned to snappingly engage flange 45 of housing 40 through recesses 48 (see FIG. 6) in the perimeter of the flange. This engagement and the configuration of covering 60 is such that the covering is pulled against sealing gasket 70 to provide an effective seal around the flange.

When removed, covering 60 enables ready access from the normally covered end of housing 40 to the area of crossbar 30 and in particular to screw 35 as shown in FIG. 1. This facilitates the ease of installation of the assembly. The removability of cover 30 also facilitates cleaning and, as noted above, permits the easy substitution of differing covers. As indicated previously, differing covers having differing colors can be used to provide a desired color match or contrast with differing colored bathtubs.

Figure 6:
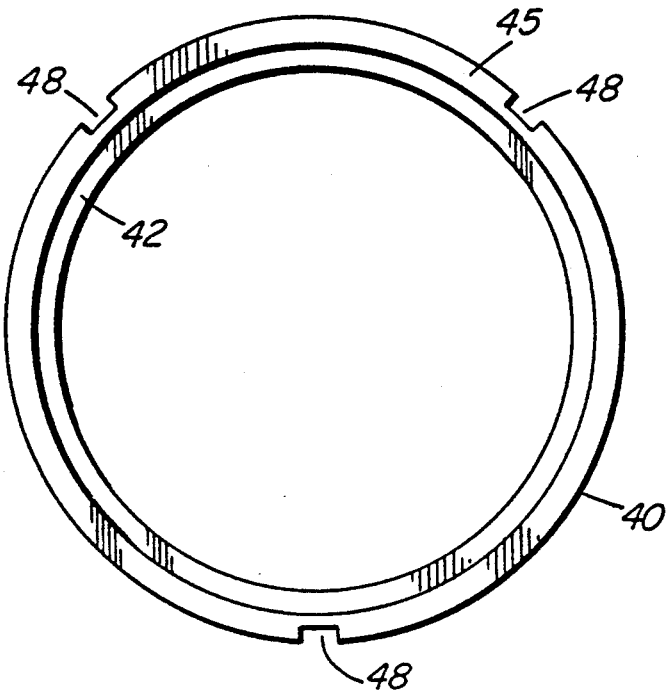
FIG. 6 is a front elevation view of the cylindrical housing shown in FIG. 5.

The central region on the surface of covering 60 is raised to a triangular apex 65 which serves as a pointer indicating the rotational position of housing 40. In the embodiment shown, it may be noted that the positioning of flanges 62 and recesses 48 is set such that covering 60 can only engage flange 45 at one angle of relative rotation between the covering and the housing. More specifically, the bottom-most recess 48 shown in FIG. 6 is at the apex of an isosceles triangle, the upper-most recesses 48 being at base corners of the triangle. However, the triangle is not equilateral. Therefore, the cover can only fit one way and, in practice, this is done such that the pointer represented by triangular apex 65 points towards bottom-most recess 48.

With the assembly as shown in FIG. 1, the only port through which water may exit bathtub 100 is that defined by openings in the perimeter of housing 40. These openings consist of openings 46 and 47 which appear in view on the near side of cylinder 40 in FIG. 1 and corresponding openings directly behind these openings on the far side of cylinder 40 in FIG. 1. The level of these openings will dictate the overflow level of the bathtub. In the particular position shown in FIG. 1, this level would be the normal overflow level determined by the level of bend 107 in pipe 105 (the openings being below this level). However, by rotating housing 40, the overflow level may be raised a substantial distance in a controlled manner.

Of course, it is not essential to use a plurality of openings such as openings 46, 47 and the openings behind these openings in FIG. 1. A single larger opening will perform the same function. However, several smaller openings may be used to perform a grating function and limit the size of foreign objects that might otherwise pass into device 10.

In some jurisdictions, regulations exist requiring that the overflow level of a bathtub be at some specified distance below the rim of the bathtub to prevent overflow should the taps be left running and forgotten. With the device of the present invention, the user would be instructed to fill the bathtub with the overflow set at its lowest position to allow the bathtub to fill to the normal level. The user would then rotate the overflow to a higher position before entering the bathtub in order to retain the water displaced by his or her body, thus providing a deeper and more luxuriant bath.

Figure 4:
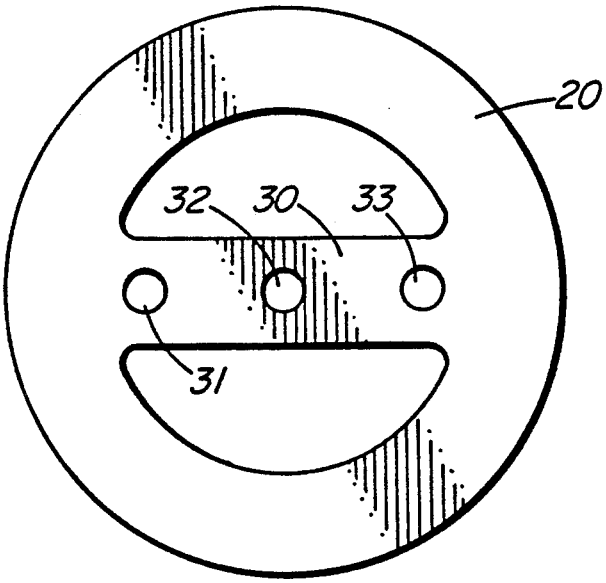
FIG. 4 is a front elevation view of the adapter ring shown in FIG. 3.
Figure 5:
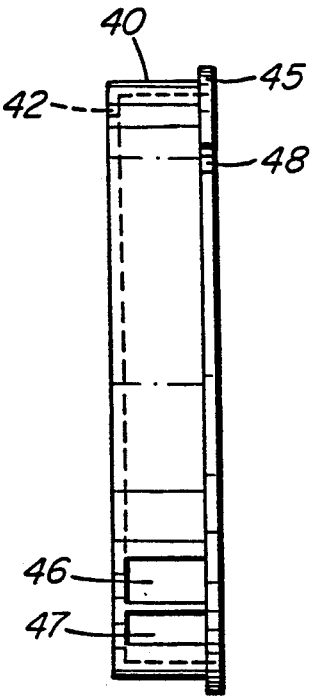
FIG. 5 is a side elevation view of the cylindrical housing shown in FIG. 1.

With reference to FIG. 4, it will be noted that crossbar 30 includes two holes 31, 33 not referred to above.

These holes are not utilized when device 10 is attached to bathtub 100 because fixture base or stud 110 only contemplates one centrally disposed screw. However, there are other conventional bathtubs many of which do not permit the attachment of a conventional fixture except with a pair of screws spaced apart in the manner indicated by the positions of holes 31, 33 in FIG. 4. By providing three holes 31, 32, 33 as shown in FIG. 4, device 10 can be attached to fixture bases calling for either one or two screws.

Without departing from the spirit and scope of the claims which follow various changes and modifications to the particular embodiment which has been described are possible and will undoubtedly occur to those skilled in the art.

We claim:

1. A bathtub overflow level control device for a bathtub, said bathtub having (i) an overflow drain pipe which provides a drain outlet from a side wall of the bathtub; and (ii) a fixture base at said outlet for attaching a bathtub fixture, said device comprising:

(a) an adapter ring 20 sized to fit around said outlet;

(b) connecting means for tightly connecting said adapter ring to said base;

(c) a housing having a cylindrical perimeter and means for engaging said housing at one end with an outer perimeter of said adapter ring for rotary frictional sliding movement of said housing about said ring;

(d) a removable covering for sealingly covering the end of said housing opposed to said one end;

(e) an overflow port in the perimeter of said housing for permitting the flow of water from said bathtub, through said housing, and into said drain outlet;

(f) sealing means for preventing the flow of water from said bathtub into said pipe except through said port.

2. A device as defined in claim 1, wherein said sealing means comprises a sealing gasket adapted to fit between said bathtub wall and said housing.

3. A device as defined in claim 2, wherein said connecting means comprises a crossbar extending diametrically across said adapter ring.

4. A device as defined in claim 3, wherein said fixture base includes a first hole for threadingly receiving a screw, said crossbar having a corresponding hole alignable with said first hole for permitting a screwed connection between said crossbar and said base.

5. A device as defined in claim 3, wherein said crossbar has a plurality of screw holes located in positions selected to permit a screwed connection to alternate fixture bases, each of such bases having threaded screw engaging holes in one or more corresponding locations.

6. A device as defined in claim 1, said covering being flexible and including means for removably snap fitting said covering with said housing.

7. A device is defined in claim 1 wherein said adapter ring is adapted to hold said pipe against said wall when connected to said base.

* * * * *